US010126674B2

(12) United States Patent
Ishidate et al.

(10) Patent No.: US 10,126,674 B2
(45) Date of Patent: Nov. 13, 2018

(54) OPTICAL SCANNING DEVICE AND IMAGE FORMING APPARATUS PROVIDED WITH OPTICAL SCANNING DEVICE

(71) Applicant: CANON KABUSHIKI KAISHA, Tokyo (JP)

(72) Inventors: Takehiro Ishidate, Tokyo (JP); Yasuaki Otoguro, Abiko (JP); Yuichiro Imai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/002,169

(22) Filed: Jan. 20, 2016

(65) Prior Publication Data

US 2016/0216633 A1 Jul. 28, 2016

(30) Foreign Application Priority Data

Jan. 22, 2015 (JP) ..... 2015-010361

(51) Int. Cl.
*G03G 15/043* (2006.01)
*G03G 15/04* (2006.01)

(52) U.S. Cl.
CPC ..... *G03G 15/043* (2013.01); *G03G 15/04072* (2013.01); *G03G 2215/0132* (2013.01)

(58) Field of Classification Search
CPC ... G03G 15/011; G03G 15/04; G03G 21/1666
See application file for complete search history.

(56) References Cited

U.S. PATENT DOCUMENTS 6,157,478 A * 12/2000 Naiki ..... G02B 26/123 347/243
2006/0139715 A1* 6/2006 Tamaru ..... G02B 26/123 359/204.1
2006/0285170 A1* 12/2006 Mamiya ..... B41J 2/471 358/305

FOREIGN PATENT DOCUMENTS

JP 2007248686 A 9/2007

* cited by examiner

*Primary Examiner* — Victor Verbitsky
(74) *Attorney, Agent, or Firm* — Canon U.S.A., Inc. IP Division

(57) ABSTRACT

A laser holder includes a bridge portion connected to a holding portion via two projecting portions so as to bridge the two projecting portions, and the bridge portion includes a contacting portion configured to come into contact with the optical box by being pressed against an optical box by a screw head of a second fixing screw.

2 Claims, 10 Drawing Sheets

OPTICAL SCANNING DEVICE AND IMAGE FORMING APPARATUS PROVIDED WITH OPTICAL SCANNING DEVICE

BACKGROUND OF THE INVENTION

Field of the Invention

The present invention relates to a fixing mechanism of a laser holder which is to be mounted on an optical scanning device.

Description of the Related Art

In the related art, an optical scanning device used in an image forming apparatus of an electrophotographic system is configured to deflect a laser beam emitted from a laser beam source such as a semiconductor laser by a deflection unit such as a rotary polygon mirror or the like and to guide the deflected laser beam to a photosensitive member with a lens or a mirror. The image forming apparatus develops an electrostatic latent image formed on the photosensitive member by being exposed to the laser beam with toner, transfers the developed toner images to a recording medium, thereby forming an image on the recording medium.

A center axis (hereinafter, referred to as an optical axis of an incident system) of a laser beam outputs from the laser beam source has a minute angular misalignment with respect to a designed angle due to variations in dimensions of components or variations in assembly between components. When the optical axis of the incident system has an angular misalignment, an incident position and the incident angle with respect to the lens is uniformly displaced with respect to designed values. Consequently, an image-forming performance with respect to the photosensitive member is impaired. In particular, when a direction in which a laser beam deflected by the deflection unit scans on the photosensitive member on the optical scanning device is referred to as a primary scanning direction, and a direction orthogonal thereto is referred to as a secondary scanning direction, a phenomenon that the optical axis of the incident system inclines in the secondary scanning direction occurs. With such a phenomenon, the incident position of the laser beam with respect to the lens is changed. The optical scanning device is designed to allow a laser beam to pass through the lens at a position having a high light-converging performance. However, if the incident position of the laser beam into the lens varies, the laser beam cannot converge adequately on the photosensitive member, and thus deterioration of an image quality of an output image may occur.

In order to solve the above-described problem, Japanese Patent Laid-Open No. 2007-248686 discloses an optical scanning device provided with an adjusting mechanism configured to incline a holding member configured to hold the laser beam source with respect to a mounting member in the secondary scanning direction.

In a case where the angular misalignment occurs with respect to the designed angle due to variation in dimension of components or variations in assembly between the components, and thus changing of the angle of the optical axis of the laser beam in the secondary scanning direction is desired, a configuration of Japanese Patent Laid-Open No. 2007-248686 can realize a stable improvement of an optical performance by adjusting the holding member in a direction of cancelling the angular misalignment without increasing component accuracy and assembly accuracy. A principle of adjustment is as follows. The holding member and the mounting member are fixed with a screw in a state of having an elastic member therebetween. When assembling the optical scanning device of Japanese Patent Laid-Open No. 2007-248686, an operator corrects an optical path of the laser beam by rotating a screw and changing a posture of the holding member by a reaction force of the elastic member.

However, adjusting the optical path of the laser beam by a tightening amount of the screw by the intermediary of the elastic member between the holding member and the mounting member, which are desired to be fixed tightly under normal circumstances means, in other words, that tightening torque of the screw generated therebetween is reduced. Fixation of the screw may be loosened by environmental variations such as vibrations or temperature increase of a main body of the image forming apparatus, and hence the adjusted optical axis of the optical path may be deviated.

In view of such circumstances, direct fixation of the holding member to the mounting member with a screw without an intermediary of the elastic member is required in order to improve a performance of the optical scanning device.

However, in order to achieve a high accuracy of the optical axis with the fixation of the holding member with the screw, a next phenomenon needs to be overcome as a new challenge. In other words, a mounting surface, which is a portion where the holding member and the mounting member come into contact with each other, and which determines the posture of the holding member, is difficult to be machined into a completely flat surface even though an attempt is made to machine the surface with a highest possible degree of accuracy. With such a slight distortion of planarity and a difference in flatness between different mounting seat faces, the seat face of the holding member is forcedly adapted to the mounting member by a strong thrust force of the screw. At this time, stress is generated at each of a plurality of fixing points with the screws. In other words, when the holding member is mounted on the mounting member with the screw, the holding member is deformed slightly, and the deformation causes a deviation of the optical path of the laser beam.

SUMMARY OF THE INVENTION

An optical scanning device of the present invention is an optical scanning device including: a semiconductor laser configured to emit a laser beam for exposing a photosensitive member, a laser holder configured to hold the semiconductor laser, and an optical member configured to guide the laser beam so that the laser beam scans the photosensitive member, including: an optical box configured to accommodate the optical member and to which the laser holder is fixed, the optical box including a first screw portion into which a first fixing screw is tightened for fixing the laser holder and a second screw portion into which a second fixing screw is tightened to be screwed for fixing the laser holder, wherein the laser holder includes a holding portion configured to hold the semiconductor laser, the holding portion including a first contacting portion configured to come into contact with the optical box by the holding portion being pressed against the optical box by a screw head of the first fixing screw screwed into the first screw portion; two projecting portions projecting from the holding portion; and a bridge portion connected to the holding portion via the two projecting portion so as to bridge the two projecting portion, the bridge portion includes: an opening; and a second contacting portion configured to come into contact with the optical box by being pressed against the optical box by a screw head of the second fixing screw passing through the opening and screwed into the second screw portion, and at least the holding portion is pressed by the first fixing screw to bring the first contact portion into contact with the optical box, and the bridge portion is pressed by the second fixing screw to bring the second contacting portion into contact with the optical box, and the laser holder is fixed to the optical box.

Further features of the present invention will become apparent from the following description of exemplary embodiments with reference to the attached drawings.

DESCRIPTION OF THE EMBODIMENTS

First Embodiment

Image Forming Apparatus

Figure 1:
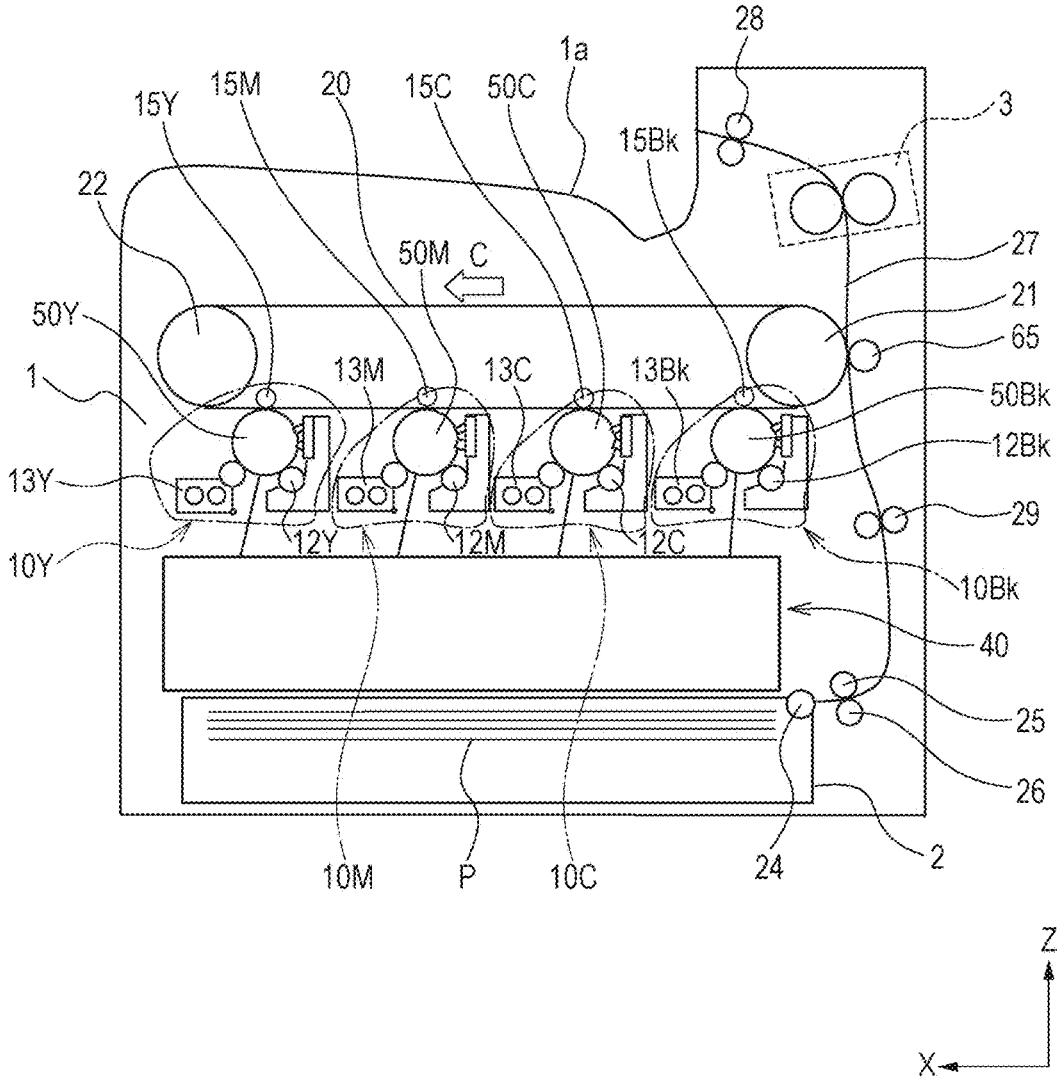
FIG. 1 is a schematic cross-sectional view of an image forming apparatus of an embodiment.

A configuration of an image forming apparatus of a first embodiment will be described. FIG. 1 is a schematic configuration drawing illustrating an entire configuration of a tandem color laser beam printer of the embodiment. The laser beam printer (hereinafter, referred to simply as a printer) includes four image forming engines 10Y, 10M, 10C, and 10Bk (illustrated by chain lines) configured to form toner images for each of yellow (Y), magenta (M), cyan (C), and black (Bk). The printer also includes an intermediate transfer belt 20. The toner images are transferred from the image forming engines 10Y, 10M, 10C, and 10Bk to the intermediate transfer belt 20. The toner images transferred to the intermediate transfer belt 20 in a superimposed manner are transferred to a recording sheet P, which corresponds to a recording medium, to form a full-color image. From now onward, symbols which indicate colors Y, M, C, and Bk are omitted unless otherwise required. In the following description, a direction of an axis of rotation of a rotary polygon mirror 42 of a motor unit 41, which will be described later is defined as a Z-axis direction, a primary scanning direction which corresponds to a scanning direction of a laser beam or a longitudinal direction of a reflection mirror 62 is defined as a Y-axis direction, and a direction perpendicular to the Y-axis and the Z-axis is defined as an X-axis direction.

The intermediate transfer belt 20 is formed in an endless shape, and is extended around a pair of belt conveyance rollers 21 and 22, and is configured in such a manner that toner images formed by the image forming engines 10 while rotating in a direction indicated by an arrow C are transferred thereto. A secondary transfer roller 65 is disposed at a position opposing the belt conveyance roller 21 by the intermediary of the intermediate transfer belt 20. The recording sheet P is inserted between the secondary transfer roller 65 and the intermediate transfer belt 20 which are in press contact with each other, and the toner images are transferred from the intermediate transfer belt 20 thereto. Four image forming engines 10Y, 10M, 10C, and 10Bk described above are disposed in parallel on a lower side of the intermediate transfer belt 20, so that the toner images formed in accordance with image information of the respective colors are transferred to the intermediate transfer belt 20 (hereinafter, referred to as a primary transfer). The four image forming engines 10 are disposed in the order of the image forming engine 10Y for yellow, the image forming engine 10M for magenta, the image forming engine 10C for cyan, and the image forming engine 10Bk for black along a direction of rotation (direction indicated by the arrow C) of the intermediate transfer belt 20.

An optical scanning device 40 configured to expose photosensitive drums 50, which are photosensitive members provided for the respective image forming engines 10, in accordance with the image information is disposed under the image forming engines 10. In FIG. 1, detailed illustration and description of the optical scanning device 40 are omitted, and will be described later with reference to FIGS. 2A and 2B. The optical scanning device 40 is commonly used for all the image forming engines 10Y, 10M, 10C, and 10Bk, and is provided with four semiconductor lasers, which are not illustrated, configured to emit a laser beam modulated in accordance with the image information of the respective colors. The optical scanning device 40 is provided with the rotary polygon mirror 42 configured to deflect the respective laser beams so that the laser beams corresponding to the respective photosensitive drums 50 scan along an axial direction of the photosensitive drums 50 (Y-axis direction) and the motor unit 41 configured to rotate the rotary polygon mirror 42. The respective laser beams deflected by the rotary polygon mirror 42 are guided onto the photosensitive drums 50 (on the photosensitive members) by an optical member installed in the optical scanning device 40 to expose the photosensitive drums 50 respectively.

The image forming engines 10 include the photosensitive drums 50 and charge rollers 12 configured to charge the photosensitive drums 50 to a uniform background potential. The image forming engines 10 include developing units 13 configured to develop electrostatic latent images formed on the photosensitive drums 50 by being exposed to the laser beams and form toner images. The developing units 13 form toner images in accordance with the image information of the respective colors on the photosensitive drums 50.

Primary transfer rollers 15 are disposed at positions opposing the photosensitive drums 50 of the image forming engines 10 with the intermediate transfer belt 20 nipped therebetween. A predetermined transfer voltage is applied to the primary transfer rollers 15, and thus the toner images on the photosensitive drums 50 are transferred to the intermediate transfer belt 20.

In contrast, the recording sheet P is supplied from a sheet feed cassette 2 stored in a lower portion of a printer housing 1 to an interior of the printer, specifically, to a secondary transfer position where the intermediate transfer belt 20 comes into contact with the secondary transfer roller 65. A pickup roller 24 and a sheet feed roller 25 configured to pull out the recording sheet P stored in the sheet feed cassette 2 are arranged in parallel above the sheet feed cassette 2. A retard roller 26 configured to prevent double feeding of the recording sheets P is disposed at a position opposing the sheet feed roller 25. A conveyance passage 27 of the recording sheet P in the interior of the printer is provided substantially vertical along a right side surface of the printer housing 1. The recording sheet P pulled out from the sheet feed cassette 2 located on a bottom portion of the printer housing 1 moves upward in the conveyance passage 27, and is fed to registration rollers 29 configured to control timing of entry of the recording sheet P into the secondary transfer position. Subsequently, the recording sheet P, after the toner images have been transferred thereto at the secondary transfer position, is fed to a fixer 3 (illustrated by broken lines) provided on a downstream side in a conveying direction. The recording sheet P having the toner images fixed thereto by the fixer 3 passes between discharge rollers 28 and is discharged to a sheet discharge tray 1*a* provided on the top of the printer housing 1.

When forming a full-color images by the color laser beam printer configured in this manner, the optical scanning device 40 firstly exposes the photosensitive drums 50 of the image forming engines 10 at a predetermined timing in accordance with the image information of the respective colors. Accordingly, latent images in accordance with the image information is formed respectively on the photosensitive drums 50 of the image forming engines 10. In order to obtain a good image quality, the latent images formed by the optical scanning device 40 need to be reproduced at a predetermined positions on the photosensitive drums 50 with high degree of accuracy and spot shapes of the laser beams for forming the latent image need to be always stable and to be capable of maintaining a desired state.

Configuration of Optical Scanning Device

Figure 2A:
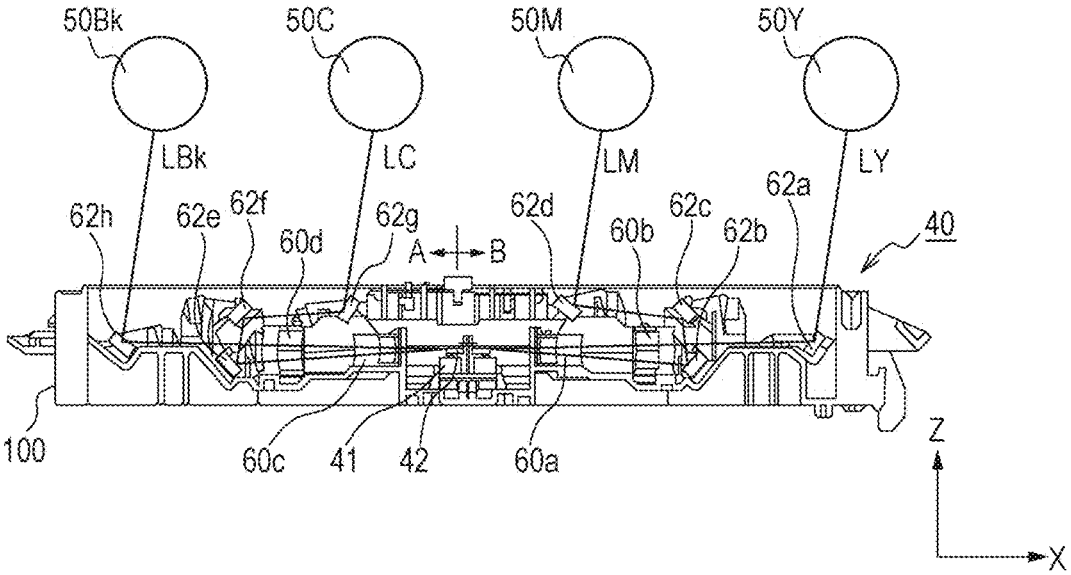
FIG. 2A is a schematic cross-sectional view of an optical scanning device of the embodiment.
Figure 2B:
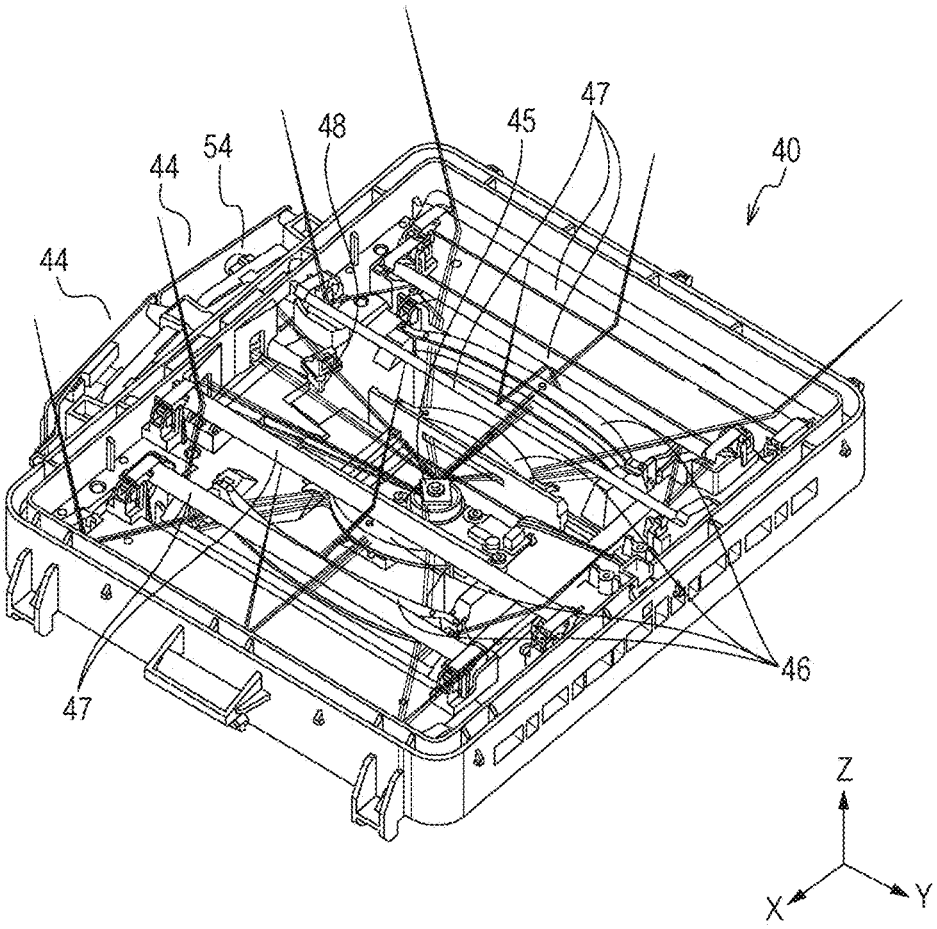
FIG. 2B is a perspective view of the optical scanning device of the embodiment.

FIG. 2A is a schematic configuration drawing illustrating an internal configuration of the optical scanning device of the embodiment. FIG. 2B is a perspective view of the optical scanning device. A light source unit, which is not illustrated, having a light source configured to emit laser beams mounted thereon, the rotary polygon mirror 42 configured to deflect the laser beams, and the motor unit 41 are installed in the interior and an outer peripheral portion of a housing 105, which is an optical box of the optical scanning device 40. In addition, optical lenses 60*a* to 60*d* and refection mirrors 62*a* to 62*h* for guiding the laser beams onto the photosensitive drums 50 and forming images are installed in the optical scanning device 40.

A laser beam LY corresponding to a photosensitive drum 50Y emitted from the light source unit, which will be described later, is deflected by the rotary polygon mirror 42 and enters the lens 60*a* arranged on a B-side in the drawing. The laser beam LY that has passed through the lens 60*a* enters the lens 60*b*, and after having passed through the lens 60*b*, is reflected from the reflection mirror 62*a*. The laser beam LY reflected from the reflection mirror 62*a* passes through a transparent window, which is not illustrated, and scans the photosensitive drum 50Y.

A laser beam LM corresponding to a photosensitive drum 50M emitted from the light source unit, which will be described later, is deflected by the rotary polygon mirror 42, and enters the lens 60*a* arranged on the B-side in the drawing. The laser beam LM passed through the lens 60*a* enters the lens 60*b*, and after having passed through the lens 60*b*, is reflected from the reflection mirror 62*b*, the reflection mirror 62*c*, and the reflection mirror 62*d*. The laser beam LM reflected from the reflection mirror 62*d* passes through the transparent window, which is not illustrated, scans the photosensitive drum 50M.

A laser beam LC corresponding to a photosensitive drum 50C emitted from the light source unit, which will be described later, is deflected by the rotary polygon mirror 42, and enters the lens 60*c* arranged on an A-side in the drawing. The laser beam LC passed through the lens 60*c* enters the lens 60*d*, and after having passed through the lens 60*d*, is reflected from the reflection mirror 62*e*, the reflection mirror 62*f*, and the reflection mirror 62*g*. The laser beam LC reflected from the reflection mirror 62*g* passes through the transparent window, which is not illustrated, scans the photosensitive drum 50C.

A laser beam LBk corresponding to a photosensitive drum 50Bk emitted from the light source unit, which will be described later, is deflected by the rotary polygon mirror 42, and enters the lens 60*c* arranged on the A-side in the drawing. The laser beam LBk that has passed through the lens 60*c* enters the lens 60*d*, and after having passed through the lens 60*d*, is reflected from the reflection mirror 62*h*. The laser beam LBk reflected from the reflection mirror 62*h* passes through the transparent window, which is not illustrated, scans the photosensitive drum 50Bk.

In recent years, in the optical scanning device, a reduction in size and a reduction in costs of the device are required. The optical scanning device of the embodiment, which will be described below, has a configuration in which the reduction in size and the reduction in costs of the device can be achieved simultaneously without causing spot positions of the laser beams to become unsteady due to vibrations caused by a vibratory force applied by a drive unit such as a motor. In particular, an fθ lens that the laser beam deflected by the rotary polygon mirror 42 enters is an elongated resin lens in many cases, and thus a problem caused by vibrations tends to occur. Therefore, in order to achieve the reduction in size, the reduction in costs, and prevention of vibrations, in the optical scanning device, a supporting configuration of the fθ lens by the housing of the optical scanning device is very important. In FIG. 1 and FIGS. 2A and 2B, the image forming apparatus provided with a plurality of the image forming engines has been described. However, a configuration including an image forming apparatus provided with one image forming engine and an optical scanning device used in the image forming apparatus is also applicable.

Figure 3:
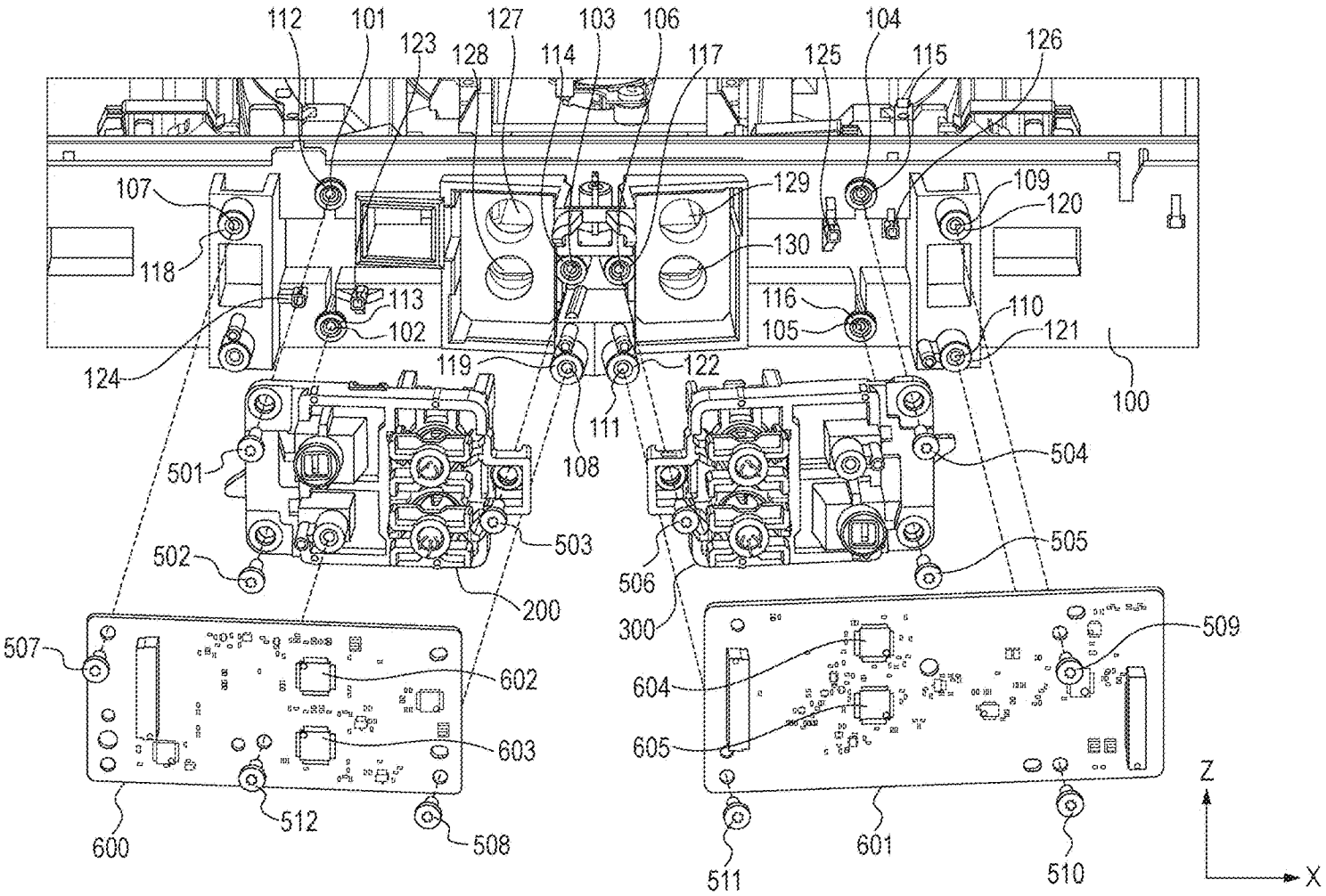
FIG. 3 is an exploded perspective view of an optical box, a laser holder, and a circuit board.

FIG. 3 is an assembly drawing of the optical scanning device 40. As illustrated in FIG. 3, an optical box 100 is provided with screw holes 101 (first screw portion), 102 (third screw portion), and 103 (second screw portion) with (into) which fixing screws 501 (first fixing screw), 502 (third fixing screw), and 503 (second fixing screw) engage (tighten) respectively described later. The optical box 100 is also provided with screw holes 104, 105, and 106 with which fixing screws 504, 505, and 506 engage, respectively. The optical box 100 is also provided with screw holes 107 and 108 with which fixing screws 507 and 508 engage respectively. Furthermore, the optical box 100 is also provided with screw holes 110, 111, and 112 with which fixing screws 510, 511, and 512 engage, respectively.

The fixing screws 501, 502, and 503 are screws for fixing a laser holder 200, which will be described later, to the optical box 100. In contrast, the fixing screws 504, 505, and 506 are screws for fixing a laser holder 300, which will be described later, to the optical box 100.

The fixing screws 507 and 508 are screws for fixing a circuit board 600, which will be described later, to the optical box 100. In contrast, the fixing screws 509, 510, and 511 are screws for fixing a circuit board 601, which will be described later, to the optical box 100.

As illustrated in FIG. 3, abutting surfaces (contacting surfaces) 112, 113, and 114 (abutting portions/contacting portions) are formed around the screw holes 101, 102, and 103 so as to surround the respective holes. An abutting surface on the laser holder 200 side, which will be described later, comes into abutment (contact) with the abutting surfaces 112, 113, and 114. Abutting surfaces 115, 116, and 117 (abutting portions) are formed around the screw holes 104, 105, and 106 so as to surround the respective holes. An abutting surface on the laser holder 300 side comes into abutment with the abutting surfaces 115, 116, and 117.

Abutting surfaces 118 and 119 (abutting portions) are formed around the screw holes 107 and 108 so as to surround the respective holes. The circuit board 600, which will be described later, comes into abutment with the abutting surfaces 118 and 119. Abutting surfaces 120, 121, and 122 (abutting portions) are formed around the screw holes 109, 110, and 111 so as to surround the respective holes. The circuit board 601 comes into abutment with the abutting surfaces 120, 121, and 122.

The optical box 100 is provided with positioning projections 123, 124, 125, and 126, which will be described later. The optical box 100 is also provided with openings 127, 128, 129, and 130 which communicate with the interior of the optical box 100 formed on a side wall thereof.

As illustrated in FIG. 3, the laser holder 300 is mounted on the optical box 100 by inverting the laser holder 200 in point symmetry about a certain point. Therefore, the screw portions on the optical box 100 side are arranged and formed on the optical box 100 so as to be a point symmetry with arrangement of the screw portions on the laser holder 200 side about a certain point. The laser holder 300 is the same as the laser holder 200, and the fixing mechanism on the optical box 100 side with respect to the laser holder 300 is the same as the fixing mechanism on the optical box 100 side with respect to the laser holder 200 in terms of function, and thus detailed description will be omitted.

A procedure for mounting the laser holders 200 and 300 and the circuit boards 600 and 601 will be described. As illustrated in FIG. 3, the laser holder 200 is fixed to the optical box 100 with the fixing screws 501, 502, and 503, and then the circuit board 600 is fixed to the optical box 100 with the fixing screw 507 and 508. In the same manner, the laser holder 301 is fixed to the optical box 100 with the fixing screws 504, 505, and 506, and the circuit board 601 is fixed to the optical box 100 with the fixing screw 509, 510, and 511.

The circuit board 600 includes a laser driver 602 configured to drive a semiconductor laser LD_Y for exposing the photosensitive drum for yellow, and a laser driver 603 configured to drive a semiconductor laser LD_M for exposing the photosensitive drum in magenta mounted thereon. The circuit board 601 includes a laser driver 604 configured to drive a semiconductor laser LD_C for exposing the photosensitive drum for cyan, and a laser driver 605 configured to drive a semiconductor laser LD_Bk for exposing the photosensitive drum in black mounted thereon.

The circuit boards 600 and 601 are provided with through holes, which are not illustrated, for allowing terminals extending from the semiconductor lasers to pass through. In a state in which the laser holder 200 and the circuit board 600 are fixed to the optical box 100, the terminals of the respective semiconductor lasers pass through these through holes and slightly project from a back surface of the circuit board 600. The circuit board 600 is configured in such a manner that the laser driver 602 and the semiconductor laser LD_Y are electrically conducted and the laser driver 603 and the semiconductor laser LD_M are electrically conducted by fixing the projecting terminals with solder. In the same manner, in a state in which the laser holder 300 and the circuit board 601 are fixed to the optical box 100, the terminals of the respective semiconductor lasers pass through these through holes and slightly project from the back surface of the circuit board 601. The circuit board 601 is configured in such a manner that the laser driver 604 and the semiconductor laser LD_C are electrically conducted and the laser driver 605 and the semiconductor laser LD_Bk are electrically conducted by fixing the projecting terminals with solder.

Subsequently, the laser holder 200 and the laser holder 300 will be described. Since the laser holder 200 and the laser holder 300 have the same shape, description will be given by using the laser holder 200.

Figure 4A:
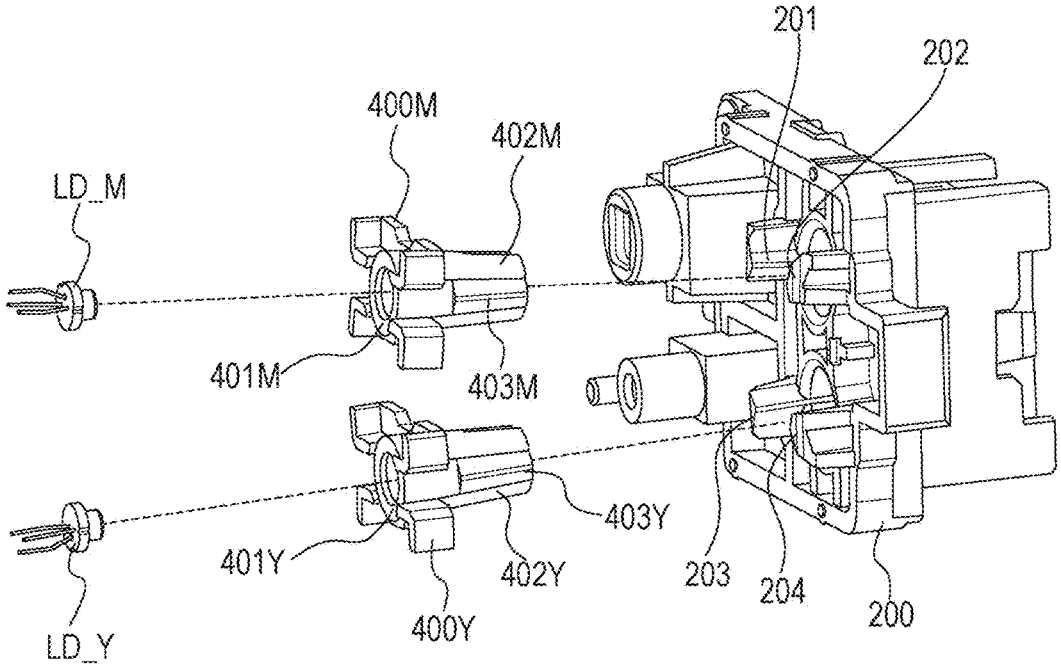
FIGS. 4A and 4B are exploded perspective views of a semiconductor laser, a chip holder, and the laser holder.
Figure 4B:
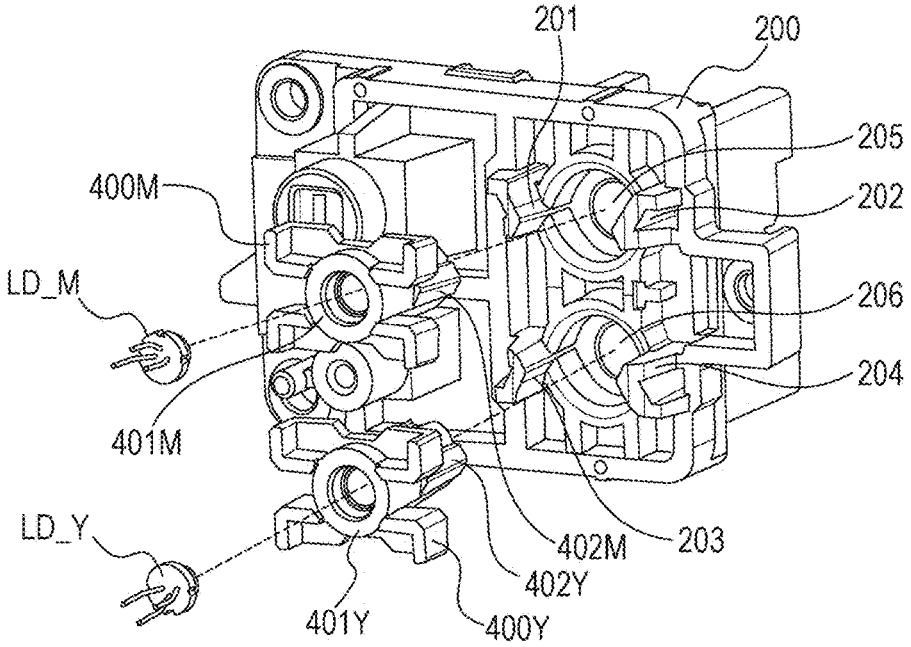

The laser holder 200 is a holding member configured to hold a chip holder 400. FIGS. 4A and 4B are exploded perspective views of a semiconductor laser LD, the chip holder 400, and the laser holder 200. The semiconductor lasers LD (LD_Y, LD_M, LD_C, LD_Bk) each integrally include one light-emitting point (not illustrated) configured to emit a laser beam into the interior of a chip package and a photodiode (not illustrated) configured to receive the laser beam emitted from the light-emitting point. The semiconductor lasers are each provided with the light-emitting point and three terminals for operating the photodiode.

The chip holder 400 is provided with opening portions 401 each provided with an opening in which the semiconductor laser LD is press-fitted, and a hollow cylindrical portion 402 projecting from the opening portion 401. As illustrated in FIG. 4B, the semiconductor lasers LD are press-fitted into the openings provided on the opening portions 401 of the chip holder 400. The laser beams emitted from the semiconductor lasers LD press-fitted into the opening portions 401 pass through the interiors of the cylindrical portions 402 and pass through openings of the cylindrical portions 402 provided on the opposite side from the opening portions 401 via the cylindrical portions 402. The cylindrical portions 402 are each provided with an adhesive agent applied portion 403 where an adhesive agent (for example, UV cured adhesive agent) is applied on an outer wall thereof. The cylindrical portions 402 are each provided with another adhesive agent applied portion 404 (see FIG. 6B, which will be described later) on the side opposite to the adhesive agent applied portion 403 via the cylindrical portion.

As illustrated in FIGS. 4A and 4B, the laser holder 200 is provided with adhesive agent applied portions 201, 202, 203, and 204 (fixing portion) to which the adhesive agent is applied, and through holes 205 and 206 for allowing laser beams to pass therethrough. When fixing chip holder 400Y and 400M to the laser holder 200 with the adhesive agent, the following procedure is to be followed. Firstly, the adhesive agent is applied both to an adhesive agent applied portion on the chip holder 400Y side and an adhesive agent applied portion on the laser holder 200 side in a state of facing each other. Next, the semiconductor laser LD_Y held by the chip holder 400Y is illuminated. The laser beam passes through the through hole 206, passes through a collimator lens 700, which will be described later, and is received by a light-receiving element provided on a jig, which is not illustrated, which is used for assembling the optical scanning device. The chip holder 400Y moves in a direction indicated by an arrow in FIG. 5A, and is adjusted to a position where the spot shape of the laser beam that the light-receiving element receives or the amount of light becomes a target value. After the adequate position of the chip holder 400Y is determined, the adhesive agent is irradiated with a UV ray so that the chip holder 400Y is fixedly adhered to the laser holder 200. The same procedure is performed for the chip holder 400M. In this manner, with the chip holders 400Y and 400M, the spot shapes of the laser beams on the respective photosensitive drums can be maintained within a range allowable in terms of design without being affected by FFP or wavelength characteristics of the semiconductor laser.

Figure 5A:
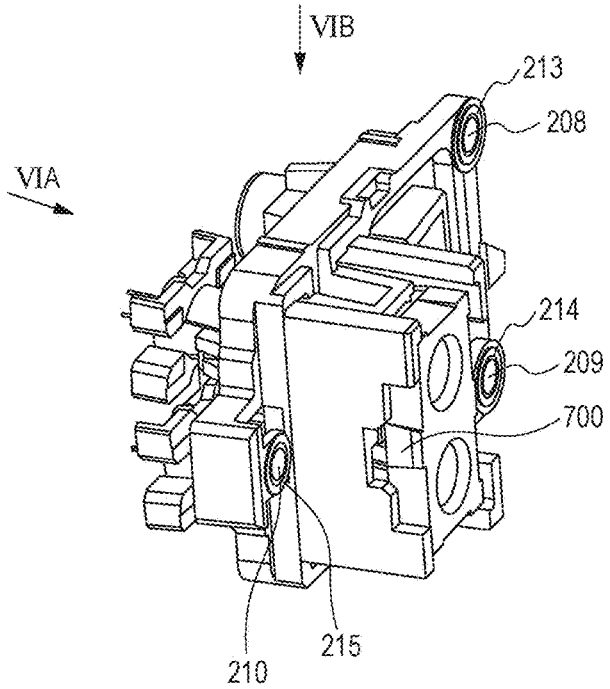
FIGS. 5A and 5B are perspective views of the laser holder and a polygon mirror.
Figure 5B:
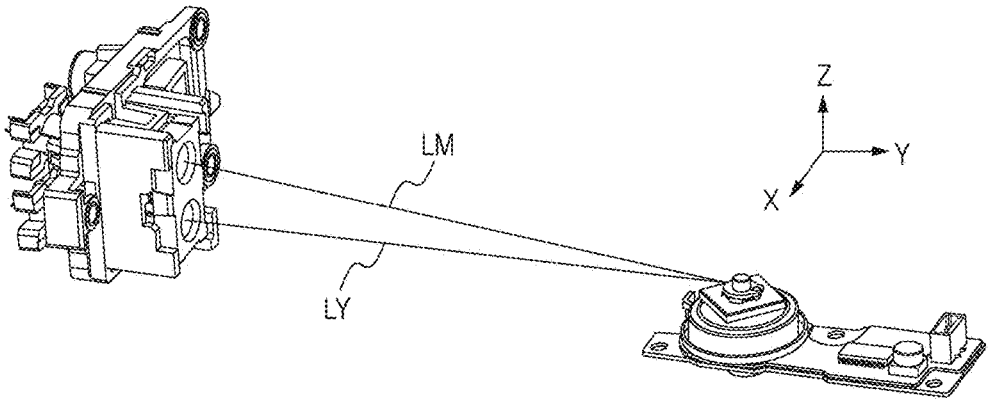
Figure 6A:
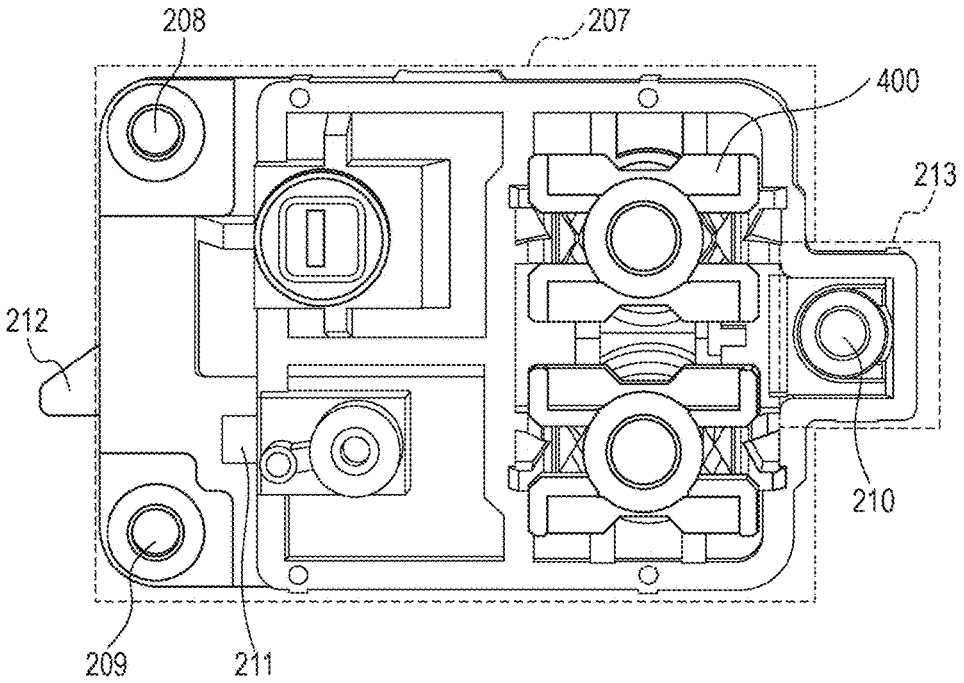
FIG. 6A is a front view of the laser holder as a single body.
Figure 6B:
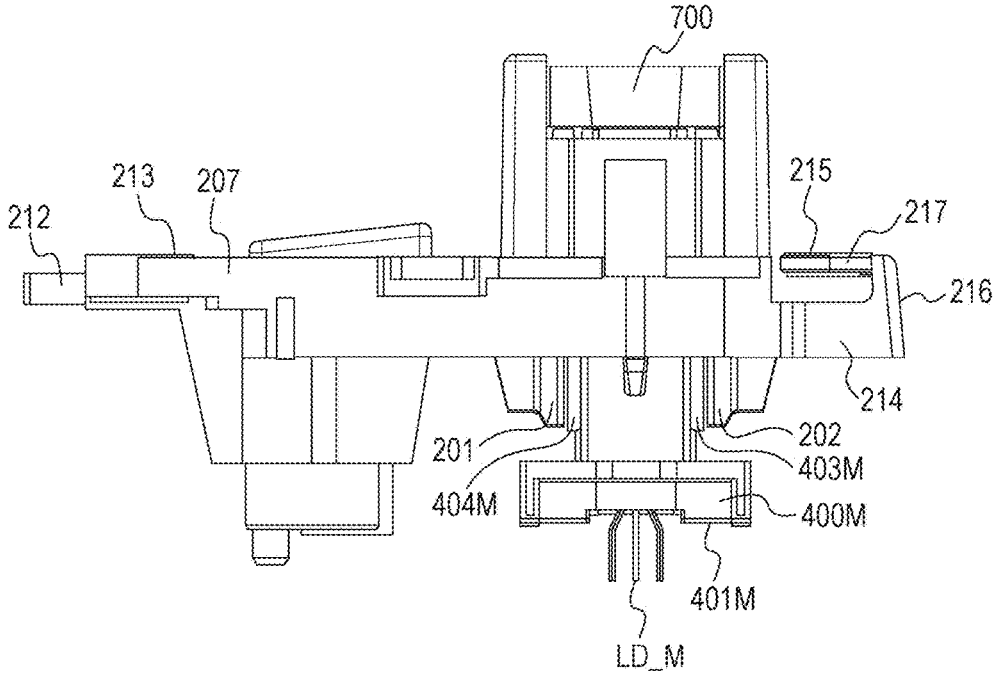
FIG. 6B is a top view of the laser holder as a single body.

Subsequently, the laser holder 200 will be described further in detail. FIG. 5A is a perspective view of the laser holder 200 to which the chip holders 400Y and 400M are adhered. FIG. 5B is a drawing illustrating a relationship between the laser holder 200 and a polygon mirror. FIG. 6A is a front view of the laser holder 200 viewed from a direction indicated by an arrow VIA in FIG. 5A. FIG. 6B is a top view of the laser holder 200 viewed from a direction indicated by an arrow VIB in FIG. 5A.

The laser holder 200 of the embodiment is provided with the collimator lens 700 as illustrated in FIG. 5A. The collimator lens 700 is a single lens, and is a twin lens configured to convert a laser beam emitted from the semiconductor laser LD_Y and a laser beam emitted from the semiconductor laser LD_M into parallel rays. As illustrated in FIG. 5B, the laser beam LY and the laser beam LM passed through the collimator lens 700 pass optical paths extending obliquely with respect to an XY plane and enters the polygon mirror.

As illustrated in FIG. 6A, portions surrounded by dot lines in the laser holder 200 is the chip holders 400M and 400Y and the holding portion 207 configured to hold the collimator lens 700. The holding portion 207 is a main body portion of the laser holder 200.

The holding portion 207 includes a through hole 208 that allows the fixing screw 501 to pass through, a through hole 209 that allows the fixing screw 502 to pass through, and a through hole 210 that allows the fixing screw 503 to pass through. The holding portion 207 is also provided with a through hole 211 in which the positioning projection 123 is inserted. The holding portion 207 is provided with a projection 212 configured to come into abutment with the positioning projection 124. The holding portion 207 is further provided with a fixing mechanism 213 extending from the holding portion 207 and including the through hole 210.

The through hole 208 and the through hole 209 are formed inside an outer shape of the holding portion 207. The through hole 208 (the center of the through hole), the through hole 209, and the through hole 210 are formed in the laser holder 200 so as to form an isosceles triangle including a segment connecting the through hole 208 and the through hole 210 and a segment connecting the through hole 209 and the through hole 210 having the same length. The through hole 205, the through hole 206, and the through hole 210 are formed in the laser holder so that the distance between the through hole 210 and the through hole 205 (see FIG. 4B) and the distance between the through hole 210 and the through hole 206 become the same. In other words, the through hole 210 is positioned at a center of a segment connecting the through hole 205 and the through hole 206 in the Z-axis direction. In addition, the through hole 210 is formed at a position closer to the through hole 205 and the through hole 206 than to the through hole 208 and the through hole 209. In other words, out of three fixing mechanisms composed of fixing screws, the fixing mechanism 213, which will be described later, is located at a position closest to the chip holder adhered to the holding portion 207. Therefore, the laser holder 200 of the embodiment has a structure in which deformation of the fixing mechanism 213 can exert the biggest impact on the posture of the chip holders adhered to the holding portion 207 compared with other fixing mechanisms.

The laser holder 200 includes an abutting surface 213 (abutting portion) that surrounds the through hole 208, an abutting surface 214 (abutting portion) that surrounds the through hole 209, and an abutting surface 215 (abutting portion) that surrounds the through hole 210 on the optical box 100 side. The abutting surfaces 213, 214, and 215 come into abutment with the abutting surfaces 112, 113, and 114 provided respectively on the optical box 100. The abutting surfaces 213, 214, and 215 are machined so that the respective surfaces thereof are located on the substantially same plane. The abutting surfaces 112, 113, and 114 provided on the optical box 100 are also machined so that the respective surfaces are located on the substantially same plane.

By "the respective abutting surfaces are located on the substantially same plane" includes a state in which the abutting surfaces are within a range of tolerance (for example, ±0.05 mm) in molding of the laser holder and the optical box in addition to a state in which the abutting surfaces are located on the completely same plane. In the case where the laser holder and the optical box are formed of a resin, the abutting surfaces of the laser holder and the optical box are formed by injection molding integrally with the main body of the laser holder and the optical box. In contrast, the case where the laser holder and the optical box are formed of a metal, the abutting surfaces of the laser holder and the optical box are formed by performing a cutting work on the laser holder and the optical box.

Figure 7:
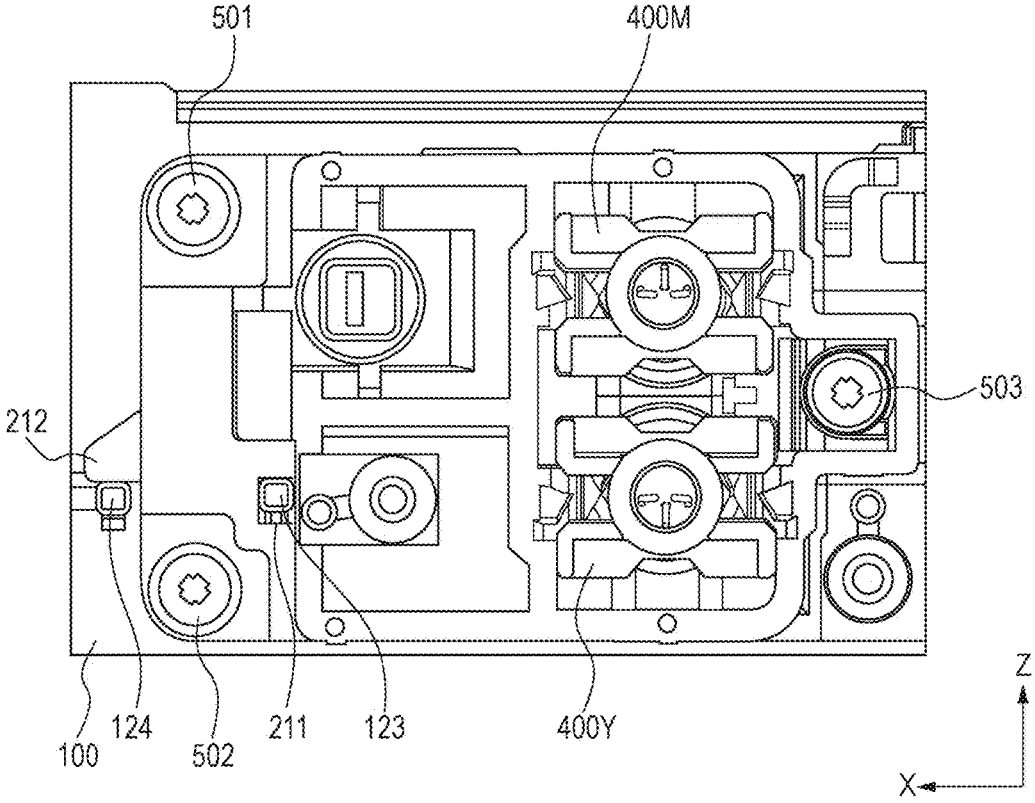
FIG. 7 is a front view of the laser holder mounted on the optical box.

FIG. 7 illustrates a state in which the abutting surfaces 213, 214, and 215 of the laser holder 200 and the abutting surfaces 112, 113, and 114 of the optical box 100 are in abutment with each other. The positioning projection 123 provided on the optical box 100 are fitted to the through hole 211 provided in the laser holder 200. The position of the laser holder 200 with respect to the optical box 100 in the X-axis direction is determined by the positioning projection 123 fitting to the through hole 211. In contrast, the positioning projection 212 projecting from the holding portion 207 is in abutment with the positioning projection 124 provided in the optical box 100. The position of the laser holder 200 with respect to the optical box 100 in the Y-axis direction is determined by the positioning projection 212 coming into abutment with the positioning projection 124. With the fixing screws 501, 502, and 503 screwed into corresponding screw holes in this state, the laser holder 200 is pressed toward the optical box 100 by screw heads of the fixing screws 501, 502, and 503, so that the abutting surfaces 213, 214, and 215 of the laser holder 200 come into abutment with the optical box 100, and the laser holder 200 is fixed to the optical box 100 in a state in which the position in both directions, namely, the X-axis direction and the Z-axis direction is determined.

The optical box 100 is provided with through holes 128 and 129. The laser beam emitted from the semiconductor laser LD_Y passes through the through hole 129 and proceeds in the interior of the optical box 100. The laser beam emitted from the semiconductor laser LD_C passes through the through hole 128 and proceeds in the interior of the optical box 100.

The circuit board 600 is mounted on the optical box 100 provided with the laser holder 200 mounted thereon. The fixing screws 507 and 508 illustrated in FIG. 3 are screwed into the corresponding screw holes 107 and 108 until the circuit board 600 comes into abutment with the abutting surfaces 118 and 119, whereby the circuit board 600 is fixed to the optical box 100.

Subsequently, the fixing mechanism 213 extending from the laser holder 200 will be described further in detail.

A thrust force acting on the laser holder 200 by the fixation with the fixing screws causes the abutting surfaces 213, 214, and 215 of the laser holder 200 to be adapted to the abutting surfaces 112, 113, and 114 of the optical box 100. As described above, the laser holder 200 and the optical box 100 are designed so that the abutting surfaces 213, 214, and 215 of the laser holder 200 and the abutting surfaces 112, 113, and 114 of the optical box 100 are present in an ideal single plane. However, the abutting surfaces of the actually molded or machined both components includes errors in inclination component and height within a range of tolerance. The gradient between the abutting surfaces are different within the range of tolerance. For example, with the abutting surface 213 of the laser holder 200 by itself, the abutting surface 213 cannot be said to be an ideal plane at the micro level, and a height difference or an inclination is included within a range of tolerance at the time of molding (machining). Therefore, in the state in which the optical box 100 and the laser holder 200 are not fixed to each other with the fixing screws, and are only the abutting surfaces are brought into contact with each other, there is case where the abutting surfaces are not in contact with each other, and only parts of the areas within the abutting surfaces are in abutment with each other and other areas are separate from each other, or a case where two pairs of the abutting surfaces are in abutment with each other and one pair of the abutment surfaces are not in abutment with each other. When the laser holder 200 manufactured in this manner is fixed to the optical box 100 with the fixing screws, the areas separate from each other receives a thrust force from the screw heads of the fixing screws, and thus the laser holder 200 is deformed. When the laser holder 200 is deformed, the postures of the chip holders fixedly adhered to the laser holder 200 may vary. The chip holders are fixed to the laser holder in a state of being adjusted to an adequate position with respect to the laser holder. A state in which the postures of the chip holders vary due to the deformation of the laser holder is not desirable because the optical paths of the laser beams are deviated from desired optical paths.

In order to solve the above-described problem, the laser holder 200 to be mounted on the optical scanning device of the embodiment is provided with the fixing mechanism 213 described below, so that variations in the postures of the chip holders due to the deformation of the laser holder 200 when mounting the laser holder 200 on the optical box 100 are reduced.

Figure 8:
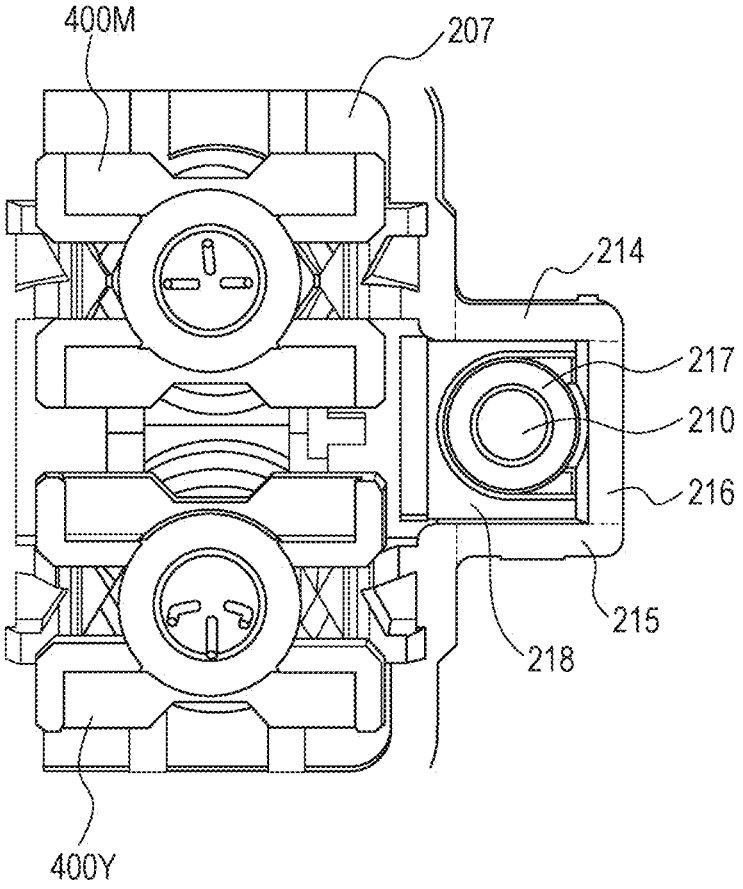
FIG. 8 is an enlarged view of a fixing mechanism provided on the laser holder.

As illustrated in FIG. 6A, a portion projecting rightward from the holding portion 207 corresponds to the fixing mechanism 213. FIG. 8 is an enlarged view of the fixing mechanism 213. As illustrated in FIG. 8, the fixing mechanism 213 includes a first projecting portion 214 and a second projecting portion 215 projecting from the holding portion 207, a bridge portion 216 configured to connect the first projecting portion 214 and the second projecting portion 215, and an opening portion 217 provided with the through hole 210.

Both ends of the bridge portion 216 are connected respectively to the first projecting portion 214 and the second projecting portion 215. The bridge portion 216 itself is not directly connected to the holding portion 207. In other words, the bridge portion 216 is connected indirectly to the holding portion 207 via the first projecting portion 214 and the second projecting portion 215. However, the bridge portion 216 itself is separated from the holding portion 207.

The laser holder 200 includes the through hole 218 surrounded by the holding portion 207, the first projecting portion 214, the second projecting portion 215, the bridge portion 216, and the bridge portion 216. The opening portion 217 extends from the bridge portion 216 toward the holding portion 207, and is located inside the through hole 218. The opening portion 217 is not connected directly to the holding portion 207 in the same manner as the bridge portion 216. In other words, the opening portion 217 is connected indirectly to the holding portion 207 via the first projecting portion 214, the second projecting portion 215, and the bridge portion 216. However, the opening portion 217 itself is separated from the holding portion 207.

As illustrated in FIG. 6B, the second projecting portion 215 has an L-shape. One end of the L-shape of the second projecting portion 215 is connected to the holding portion 207, and the other end of the L-shape includes an opening portion 215 extending toward the holding portion 207. In other words, when viewing the fixing mechanism 213 from the view point of FIG. 6B, the fixing mechanism 213 has a U-shape, and one end of the U-shape is connected to the holding portion 207, and the other end of the U-shape is a free end. A width of a gap at the closest portion between the opening portion 217 and the holding portion 207 is approximately 1 mm.

Mounting of the fixing screws 501, 502, and 503 to the optical box 100 is achieved by fixing the fixing screw 501 and the fixing screw 502 firstly and then mounting the fixing screw 503. In other words, out of a plurality of fixing screws, the fixing screw 503 for the fixing mechanism 213 is fixed lastly to the optical box 100.

A physical space is present between the fixing mechanism 213 and the holding portion 207. Accordingly, a thrust force applied to the fixing mechanism 213 is not transmitted directly to the holding portion 207. For example, in a state in which the fixing screws 501 and 502 are fixed and the fixing screw 503 is not tightened yet, it is assumed that a minute gap is generated between the abutting surface 215 of the laser holder 200 and an abutting surface 114 of the optical box 100. In this case, by receiving a thrust force from the fixing screw 503 as the fixing screw 503 is tightened, the opening portion 217 is distorted with respect to the bridge portion 216, or a connecting portion between the opening portion 217 and the bridge portion 216 is slightly deformed. That is, a thrust force acting from the fixing screw 503 to the opening portion 217 when tightening the fixing screw 503 is absorbed by the opening portion 217 and the bridge portion 216. Since the opening portion 217 is separated from the holding portion 207, a thrust force that the opening portion 217 receives from the fixing screw 503 is less likely to be propagated to the holding portion 207.

In contrast, in a state in which the fixing screws 501 and 502 are tightened and the fixing screw 503 is not tightened yet, it is assumed that the abutting surface 215 of the laser holder 200 and the abutting surface 114 of the optical box 100 come into contact with each other. In this case, the opening portion 217 that receives a resisting force from the abutting surface 114 is distorted with respect to the bridge portion 216, or the connecting portion between the opening portion 217 and the bridge portion 216 is slightly deformed. That is, a thrust force acting from the fixing screw 503 to the opening portion 217 when tightening the fixing screw 503 is absorbed by the opening portion 217 and the bridge portion 216. Since the opening portion 217 is separated from the holding portion 207, a resisting force that the opening portion 217 receives from the abutting surface 114 is less likely to be propagated to the holding portion 207.

Figure 9A:
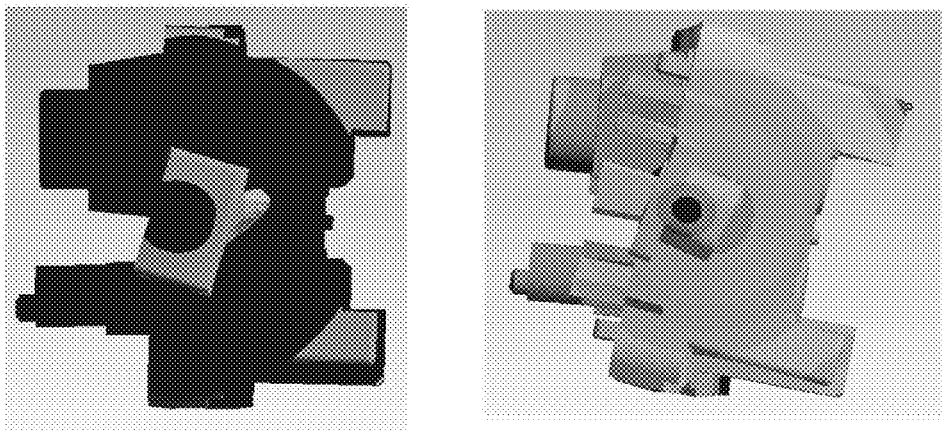
FIGS. 9A and 9B illustrate results of simulation for comparing an amount of deformation of the laser holder of the embodiment and an amount of deformation of a laser holder of a comparative example.
Figure 9B:
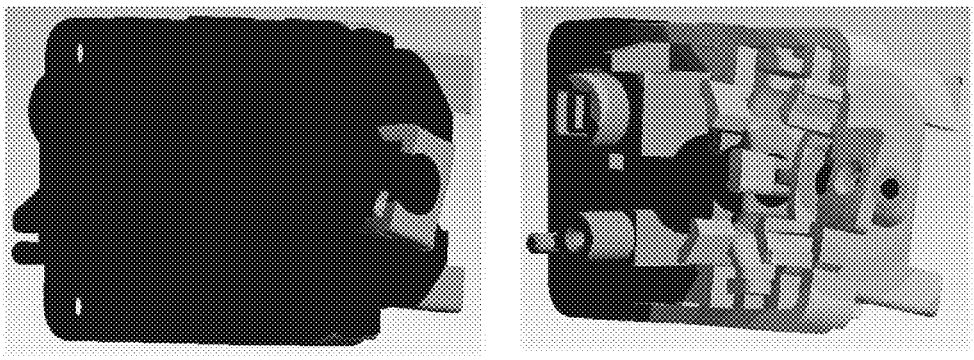

FIGS. 9A and 9B each illustrate results of simulation of the amount of deformation of the laser holder in a state in which the laser holder of the present invention is fixed to the optical box with the fixing screw. FIG. 9A illustrates a laser holder according to a comparative example, and FIG. 9B illustrates the laser holder 200 of the embodiment. The laser holder according to the comparative example illustrated in FIG. 9A is not provided with the fixing mechanism 213 of the present embodiment. FIGS. 9A and 9B each indicate the amount of deformation of the laser holder 200 itself with gradation. FIGS. 9A and 9B indicate that the denser the color becomes, the smaller the amount of deformation is. FIGS. 9A and 9B illustrate the results of simulation in which the laser holders are visually excessively deformed for the sake of easy understanding of the amount of deformation.

It is understood that the laser holder of the comparative example illustrated in FIG. 9A is deformed so that the laser holder is twisted by tightening the fixing screw at a position closest to the chip holder (upper drawing of FIG. 9A), and the amounts of deformation of portions which hold the chip holders and a portion which holds a collimator lens are significant. In this manner, when the laser holder is deformed, the optical paths of the laser beams do not pass through the ideal optical paths, and deterioration in the image quality may result.

In contrast, with the laser holder 200 of the embodiment, since the opening portion 217 pushed by the fixing screw 503 is separated from the holding portion 207, so that the thrust force that the opening portion 217 receives from the fixing screw 503 is less likely to be propagated to the holding portion 207. A significant deformation stays in the fixing mechanism 213, and the amount of deformation of the portion where the chip holders are adhered is smaller than that of the laser holder of the comparative example. In this manner, the laser holder 200 of the embodiment is provided with the fixing mechanism 213 and is configured to reduce the deformation caused by fixing with the fixing screw.

Figure 10:
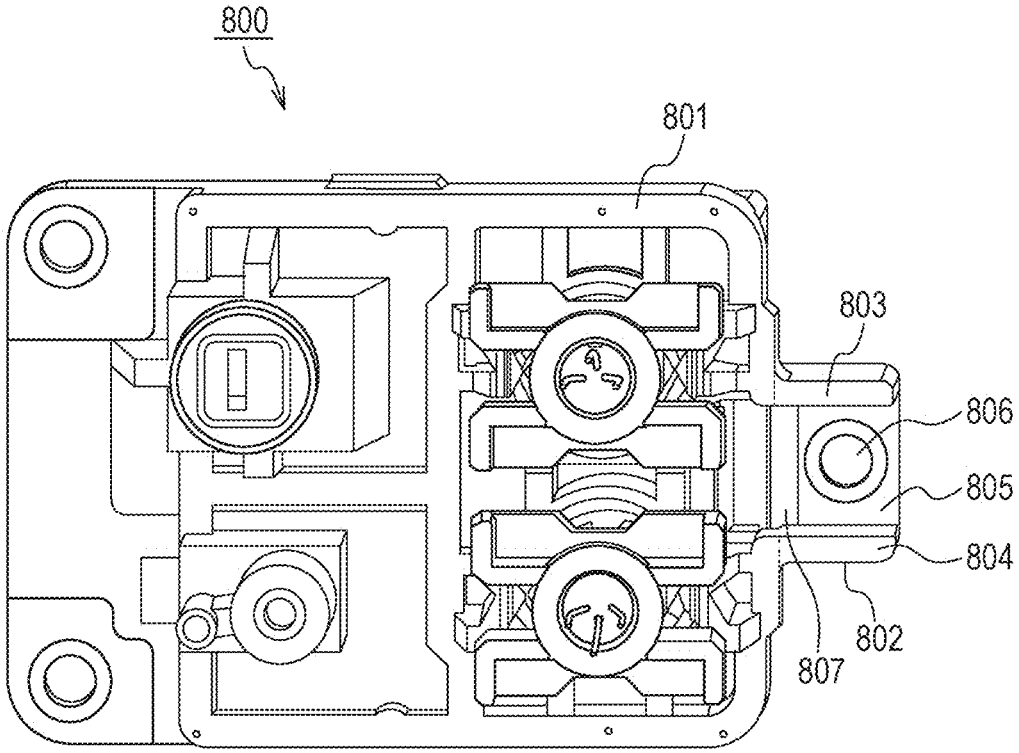
FIG. 10 is a deformation example of a laser holder.

FIG. 10 is a drawing illustrating a laser holder 800, which is a modification of the laser holder 200 illustrated in FIGS. 6A and 6B. Description of the same parts as those in FIG. 7 will be omitted. The laser holder 800 includes a fixing mechanism 802 projecting from a holding portion 801. The fixing mechanism 802 includes a first projecting portion 803 and a second projecting portion 804 projecting from the holding portion 801, and a bridge portion 805 configured to connect the first projecting portion 803 and the second projecting portion 804. In addition, a through hole 806 which allows the fixing screw to pass through is provided in the bridge portion 805. An opening 807 surrounded by the holding portion 801, the first projecting portion 803, the second projecting portion 804, and the bridge portion 805 is present. In other words, the bridge portion 805 is connected indirectly to the holding portion 801 via the first projecting portion 803 and the second projecting portion 804. However, the bridge portion 805 itself is separated from the holding portion 801. In this manner, a configuration in which the through hole that allows an insertion of the fixing screw is provided in the bridge portion 805 itself is also applicable.

As described before, the laser holder 200 of the embodiment is capable of reducing minute variations in posture of the semiconductor laser due to the deformation of the laser holder 200 itself occurring when mounting the laser holder 200 to the optical box 100.

A probability of an occurrence of deviation of the optical path of a laser beam caused by deformation of the laser holder fixed to the optical box with the fixing screw may be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010361, filed Jan. 22, 2015, which is hereby incorporated by reference herein in its entirety.

What is claimed is:

1. An optical scanning device comprising:

a semiconductor laser configured to emit a laser beam for exposing a photosensitive member;

a laser holder, which is a resin molded product, configured to hold the semiconductor laser;

an optical member configured to guide the laser beam so that the laser beam scans the photosensitive member;

an optical box configured to accommodate the optical member and including a side wall to which the laser holder is fixed, the optical box including (i) a first screw portion provided to the side wall and into which a first fixing screw is tightened for fixing the laser holder to the side wall, (ii) a second screw portion provided to the side wall and into which a second fixing screw is tightened for fixing the laser holder to the side wall, and (III) a third screw portion provided to the side wall and into which a third fixing screw is tightened for fixing the laser holder to the side wall;

wherein the laser holder includes:

a holding portion which is a main body of the laser holder and formed with a hole configured to allow the first screw to pass therethrough and a hole configured to allow the third screw to pass therethrough, wherein the holding portion includes:

fixing portions configured to attach the semiconductor laser; and a first contacting portion formed adjacent to the holes and contacts with the side wall;

a fixing mechanism protruding from an outer peripheral portion of the holding portion in a direction crossing with the second screw, the fixing mechanism includes:

two projecting portions projecting from the holding portion, a bridge portion connected to the holding portion via the two projecting portions so as to bridge the two projecting portions, and a second contacting portion formed adjacent to a hole through which the second screw passes;

wherein the second contacting portion is disposed inside the holes that is formed by the holding portion, two projecting portions and the bridge portion in an insertion direction of the second screw, wherein the second contacting portion is connected with a bridge portion and not connected with a holding portion, wherein the laser holder is fixed to the optical box by the first contacting portion abutting on the side wall by the first screw being fixed to the first screw portion, the second contacting portion abutting on the side wall by the second screw being fixed to the second screw portion, and the third contacting portion abutting on the side wall by the third screw being fixed to the third screw portion.

2. The optical scanning device according to claim 1, wherein the holding portion holds the semiconductor laser and another semiconductor laser, a first through hole to which the semiconductor laser is fixed and a second through hole to which the another semiconductor laser is fixed.

* * * * *